US007886572B2

(12) United States Patent
Harpham

(10) Patent No.: US 7,886,572 B2
(45) Date of Patent: Feb. 15, 2011

(54) METHOD FOR CALIBRATING A BACKLASH IMPULSE DEVICE IN A SPORT IMPLEMENT

(76) Inventor: Neil A. Harpham, 18 Walker Drive, Charlottetown, Prince Edward Island (CA) C1A 8S6

( * ) Notice: Subject to any disclaimer, the term of this patent is extended or adjusted under 35 U.S.C. 154(b) by 435 days.

(21) Appl. No.: 12/219,338

(22) Filed: Jul. 21, 2008

(65) Prior Publication Data

US 2008/0282768 A1 Nov. 20, 2008

(30) Foreign Application Priority Data

Feb. 1, 2007 (WO) ..... PCT/CA2007/000136

(51) Int. Cl.
*G01L 5/00* (2006.01)
*A63B 53/00* (2006.01)

(52) U.S. Cl. ..... 73/11.01; 473/326

(58) Field of Classification Search ..... 73/11.01; 473/326

See application file for complete search history.

(56) References Cited

U.S. PATENT DOCUMENTS

| | | | | |
|---|---|---|---|---|
| 690,940 | A | 1/1902 | Febiger | |
| 1,561,595 | A | 11/1925 | Davis | |
| 1,825,244 | A | 9/1931 | Nero | |
| 2,067,556 | A | 1/1937 | Wettlaufer | |
| 2,592,013 | A | 4/1952 | Curley | |
| 3,172,438 | A | 3/1965 | Gianelli | |
| 3,589,731 | A | 6/1971 | Chancellor | |
| 3,945,646 | A | 3/1976 | Hammond | |
| 3,951,413 | A | 4/1976 | Bilyeu | |
| 3,993,314 | A | 11/1976 | Harrington | |
| 4,057,250 | A | 11/1977 | Kuban | |
| 4,174,110 | A | 11/1979 | Yamamoto | |
| 4,353,551 | A | 10/1982 | Arieh | |
| 4,655,458 | A * | 4/1987 | Lewandowski | 473/326 |
| 4,730,830 | A | 3/1988 | Tilley | |
| 4,869,507 | A | 9/1989 | Sahm | |
| 4,928,965 | A | 5/1990 | Yamaguchi | |
| 5,046,740 | A | 9/1991 | D'Eath | |
| 5,058,895 | A | 10/1991 | Igarashi | |
| 5,082,279 | A | 1/1992 | Hull | |

(Continued)

FOREIGN PATENT DOCUMENTS

| | | |
|---|---|---|
| CA | 212802 | 8/1921 |

(Continued)

*Primary Examiner*—Hezron Williams
*Assistant Examiner*—Nathaniel Kolb
(74) *Attorney, Agent, or Firm*—Mario Theriault

(57) ABSTRACT

The calibration of a backlash impulse device in a sport implement (20) is effected by firstly measuring the natural frequency of the striking surface (26) of the implement; determining from the measured natural frequency, a time of occurrence *T* and a duration of a period of elastic recovery *R' of the striking surface (26) in a first vibration cycle *P* following an impact on the striking surface (26). The method also comprises the step of adjusting a distance of travel 'D' of the movable mass (32) inside the backlash impulse device during a strike of a ball with the sport implement (20), such that an impulse (62) is generated on the striking surface (26) by this movable mass (32) during the strike, at the same time as the occurrence of the period of elastic recovery 'R' of the striking surface, in the first vibration cycle 'P' following the strike.

7 Claims, 4 Drawing Sheets

U.S. PATENT DOCUMENTS

| | | | | |
|---|---|---|---|---|
| 5,121,922 | A | | 6/1992 | Harsh |
| 5,143,571 | A | | 9/1992 | Lacoste |
| 5,195,747 | A | | 3/1993 | Choy |
| 5,219,408 | A | | 6/1993 | Sun |
| 5,263,713 | A | | 11/1993 | Taylor |
| 5,505,453 | A | | 4/1996 | Mack |
| 5,613,916 | A | * | 3/1997 | Sommer ..... 473/332 |
| 5,628,697 | A | | 5/1997 | Gamble |
| 5,632,693 | A | | 5/1997 | Painter |
| 5,674,132 | A | | 10/1997 | Fisher |
| 5,703,294 | A | | 12/1997 | McConnell |
| 5,776,009 | A | | 7/1998 | McAtee |
| 5,803,829 | A | | 9/1998 | Hayashi |
| 5,816,963 | A | | 10/1998 | Brooks |
| 5,873,791 | A | | 2/1999 | Allen |
| 5,890,973 | A | | 4/1999 | Gamble |
| 6,306,048 | B1 | | 10/2001 | McCabe |
| 6,332,849 | B1 | | 12/2001 | Beasley |
| 6,390,933 | B1 | | 5/2002 | Galloway |
| 6,527,648 | B2 | | 3/2003 | Erickson |
| 6,551,199 | B2 | | 4/2003 | Viera |
| 6,558,271 | B1 | | 5/2003 | Beach |
| 6,641,490 | B2 | | 11/2003 | Ellemor |
| 6,709,344 | B2 | | 3/2004 | Erickson |
| 6,872,148 | B2 | | 3/2005 | Lee |
| 6,898,971 | B2 | | 5/2005 | Dilz, Jr. |
| 6,960,142 | B2 | | 11/2005 | Bissonnette |
| 6,997,035 | B2 | | 2/2006 | Saegusa |
| 7,037,213 | B2 | | 5/2006 | Otoguro |
| 2003/0045374 | A1 | | 3/2003 | Viera |

FOREIGN PATENT DOCUMENTS

| | | |
|---|---|---|
| CA | 264096 | 9/1926 |
| CA | 366875 | 6/1937 |
| CA | 386136 | 1/1940 |
| CA | 386137 | 1/1940 |
| CA | 844455 | 6/1970 |
| CA | 1231734 | 1/1988 |
| CA | 1304428 | 6/1992 |
| CA | 1317751 | 5/1993 |
| CA | 2072706 | 12/1994 |
| CA | 2146717 | 10/1996 |
| CA | 2271927 | 5/1998 |
| CA | 2254054 | 6/1999 |
| CA | 2392884 | 6/2001 |
| CA | 2515604 | 8/2004 |
| CA | 2204762 | 5/2005 |

* cited by examiner

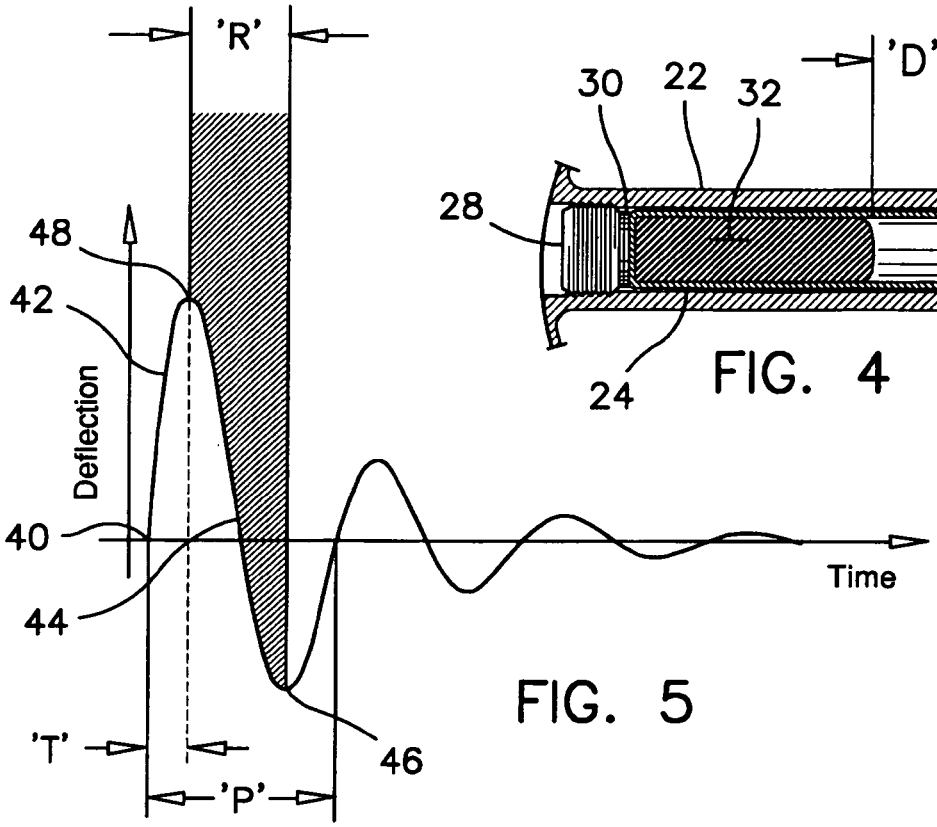
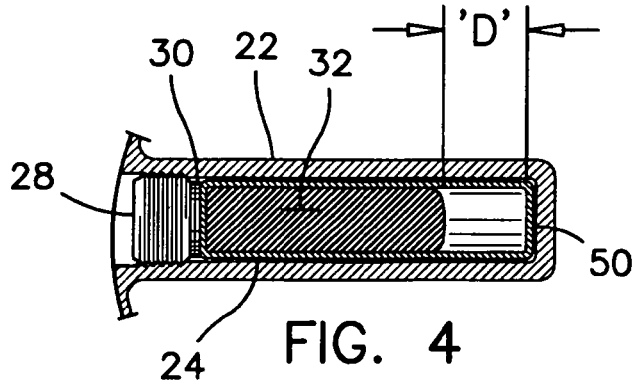
FIG. 4
FIG. 5
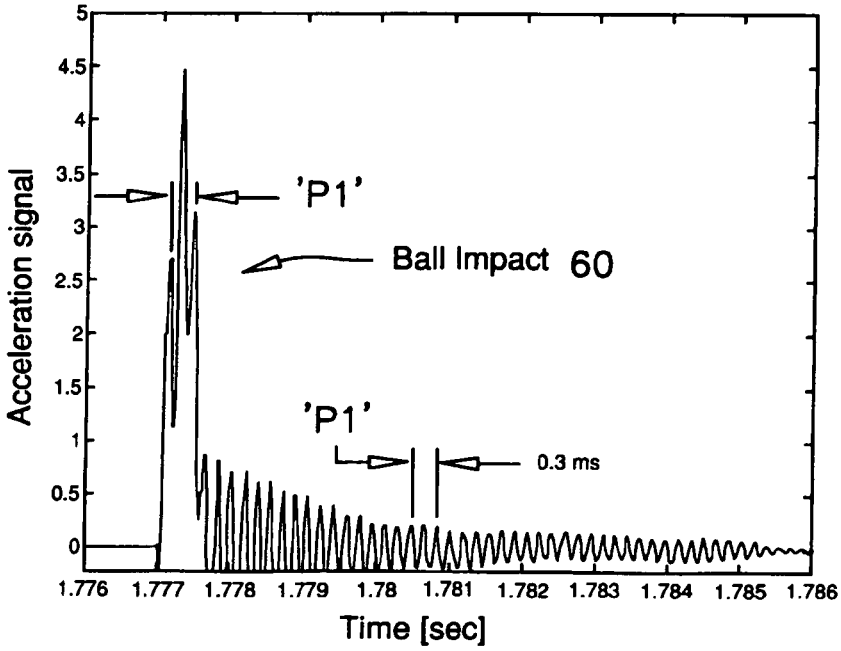
FIG. 6 a - Capsule with 14 grams of mercury
(free space 'D' = 0.343 inch)
swing speed 8 mph b - Capsule with 16 grams of mercury
(free space 'D' = 0.229 inch)
swing speed 8 mph

METHOD FOR CALIBRATING A BACKLASH IMPULSE DEVICE IN A SPORT IMPLEMENT

FIELD OF THE INVENTION

This invention pertains to sport implements having backlash impulse devices mounted therein. In a more descriptive example, this invention pertains to golf clubs each having a movable element mounted in the head thereof for generating and transmitting a backlash impulse to the striking surface of the club. Still more particularly, it pertains to a method for calibrating the timing of a backlash impulse to coincide with the elastic recovery of the striking surface of the club, during the first vibration cycle in the striking surface of the club following an impact.

BACKGROUND OF THE INVENTION

Golf club manufacturers have proposed various golf club heads with enhanced shape restitution so that amateur golfers are capable of driving a golf ball over a long distance. In recent years in particular, this has been achieved through improvements in golfclub head structures and materials.

Another method which has been used since earlier times for improving the striking distance of a golf ball consists of forming a cavity inside the club head and partly filling the cavity with a movable mass such as one or more metal slugs, metal beads or liquid mercury. Upon contact of the golf club with a golf ball during a strike, the club head decelerates to some extent and the movable mass therein strikes the forward end of the cavity, thereby transmitting a backlash impulse to the face of the club head.

Prior inventors have obtained longer and straighter shots using golf clubs having these backlash impulse devices mounted therein. In that regard, the following documents constitute a good inventory of backlash impulse devices of the prior art for golf clubs and other sport implements.

The first series of documents describe various golf club heads each having a cavity therein partly filled with mercury. As the club head strikes a ball, the liquid mercury dashes against the forward end of the cavity and transmits its inertia to the club face, for increasing the energy transmitted to the ball. This general concept has been disclosed in the following documents;

U.S. Pat. No. 1,561,595 issued to T. J. Davis on Nov. 17, 1925;
U.S. Pat. No. 2,067,556 issued to W. L. Wettlaufer on Jan. 12, 1937;
U.S. Pat. No. 3,951,413 issued to B. Bilyeu on Apr. 20, 1976;
U.S. Pat. No. 3,993,314 issued to L. E. Harrington et al., on Nov. 23, 1976;
U.S. Pat. No. 4,655,458 issued to R, I. Lewandowski on Apr. 7, 1987;
U.S. Pat. No. 5,628,697 issued to C. L. Gamble on May 13, 1997;
U.S. Pat. No. 5,890,973 issued to C. L. Gamble on Apr. 6, 1999;
U.S. Pat. No. 6,641,490 issued to J. W. Ellemor on Nov. 4, 2003;
U.S. Pat. No. 6,551,199 issued to A. A. Viera on Apr. 22, 2003;
CA Patent 386,137 issued to W. L. Wettlaufer on Jan. 9, 1940.

The second series of documents listed herein below describe club heads each having one or more cavities therein and one or more metal slugs or metal pellets mounted inside these cavities. The loose pieces are movable inside the club head to strike the back side of the striking surface when the club strikes a ball. These documents are;

U.S. Pat. No. 0,690,940 issued to H. B. Febiger on Jan. 14, 1902;
U.S. Pat. No. 1,825,244 issued to J. J. Nero on Sep. 29, 1931;
U.S. Pat. No. 2,592,013 issued to T. F. Curley on Apr. 8, 1952;
U.S. Pat. No. 3,589,731 issued to C. W. Chancellor, Jr., on Jun. 29, 1971;
U.S. Pat. No. 5,046,740 issued to R. A. D'Eath on Sep. 10, 1991;
U.S. Pat. No. 5,121,922 issued to R. L. Harsh, Sr., on Jun. 16, 1992;
U.S. Pat. No. 5,613,916 issued to R. Sommer on Mar. 25, 1997;
U.S. Pat. No. 5,776,009 issued to J. P. McAtee on Jul. 7, 1998;
U.S. Pat. No. 5,803,829 issued to T. Hayashi on Sep. 8, 1998;
U.S. Pat. No. 7,037,213 issued to M. Otoguro on May 2, 2006.

The concept of using a movable mass to generate a backlash impulse has also been used in other sport implements, and for example in tennis rackets, as described in the following documents;

U.S. Pat. No. 4,057,250 issued to W. G. Kuban on Nov. 8, 1977;
U.S. Pat. No. 4,353,551 issued to S. Arieh et al., on Oct. 12, 1982.

Other inventors have recognized the fact that the energy transmitted to a ball by a striking implement is depending upon a relationship between the natural restitution of the ball surface and the natural restitution of the striking surface of the sport implement. The following document describes a method to match the natural frequency of a golf club with the natural frequency of a golf ball, so that the restitution of their respective surfaces are in phase with each other. This document is;

U.S. Pat. No. 4,928,965 issued to T. Yamaguchi et al., on May 29, 1990;

The same concept has also been applied to a baseball bat as described in;

U.S. Pat. No. 5,816,963 issued to R. Brooks et al., on Oct. 6, 1998.

Although the prior art on the subject of backlash impulse devices is extensive, it is believed that an important aspect of the dynamics involved in this science has been overlooked in the past. It is believed that a timing of a backlash impulse in relation with the time of contact between a ball and the striking surface of a club head is very important, and has not been addressed in prior art literature.

It will be appreciated that if a backlash impulse occurs when the striking surface of a club has not yet reached its elastic limit during a strike, this impulse has a detrimental effect of lessening the elastic deflection of the striking surface, and thereby lessening the amount of energy transferred to the ball. On the other hand, if the impulse occurs after the ball has left the striking surface, it has no effect at all on the striking distance.

Contrary to accepted wisdom in the art, it is believed that backlash impulse devices cannot be readily mounted into golf clubs available for sale, and be used by any golfer irregardless of their swing speeds. It is believed that the time period available for obtaining advantageous results with such a device is a narrow time range within the first vibration cycle in the club face following an impact. It is believed that the backlash impulse must be synchronized to occur within this narrow time range.

Therefore, it is believe that a need exists in the golf club manufacturing industry for a method to calibrate the timing of a backlash impulse with both the swing speed of a golfer and the natural frequency of the striking surface of the club used by that golfer, so that the impulse has a maximum effect on a struck ball.

SUMMARY OF THE INVENTION

In the present invention, there is provided a method for calibrating a backlash impulse device such that an impulse produced by the device occurs during the period of elastic recovery of the striking surface of the club, during a first vibration cycle following an impact on the striking surface. The kinetic energy of the movable mass inside the device is thereby transmitted substantially entirely to the ball struck by the club.

Broadly, in accordance with a general aspect of the present invention there is provided a method for calibrating the timing of a backlash impulse device of the type having a movable mass therein, in a sport implement. This method comprises the steps of; measuring the natural frequency of the striking surface of the sport implement; determining from the measured natural frequency, a time of occurrence and a duration of a period of elastic recovery of the striking surface in a first vibration cycle following an impact on the striking surface. The method according to the present invention also comprises the step of adjusting a distance of travel of the movable mass during a strike of a ball with the sport implement, such that an impulse generated by this movable mass reaching the end of its travel during the strike, occurs during the period of elastic recovery of the striking surface, in the first vibration cycle following the strike.

In another aspect of the present invention, the sport implement is a golf club and the movable mass is a mercury mass contained in a cylindrical capsule, and the step of adjusting a distance of travel comprises the step of selecting a cylindrical capsule from a plurality of cylindrical capsules each having a same volume of mercury, and an unique length and open space therein.

A number of capsules are preferably manufactured and labelled according to the length of a free space inside each one. A club can then be calibrated by installing in it, a capsule having the determined free space therein to correspond to the swing speed of a golfer and to the natural frequency of the striking surface of the club.

A same amount of mercury in each capsule is advantageous for maintaining the natural frequency of the golf head in a same range when replacing one mercury capsule for another.

In another aspect of the present invention, the step of adjusting a length of the capsule comprises the step of selecting a length of the capsule such that a movement of the mercury mass inside the capsule when the golf club strikes a golf ball, generates a backlash impulse on the striking surface of the club, at the beginning of the period of elastic recovery of the striking surface, or at a mid-span along the period of elastic recovery. Therefore, when a hard golf ball having a fast shape restitution is used, the probabilities of transmitting energy from the backlash impulse to the ball before the ball leaves the striking surface of the club, are far better than an impulse occurring at the end of the period of elastic recovery.

In yet another aspect of the present invention the step of selecting is effected by extrapolating from two separate vibration measurements of impulses on the striking surface of the club, caused by two cylindrical capsules alternately mounted in a golf club, in two different experiments carried out at a same swing speed. This aspect of the method according to the present invention is more precise than one involving theoretical calculations because the actual measurements include coefficients related to friction or other variables which could otherwise be difficult to estimate.

This brief summary has been provided so that the nature of the invention may be understood quickly. A more complete understanding of the invention can be obtained by reference to the following detailed description of the preferred embodiments thereof in connection with the attached drawings.

BRIEF DESCRIPTION OF THE DRAWINGS

The attached drawings show a golf club head with a mercury capsule mounted therein. These drawings are used as an example to facilitate a description of a preferred embodiment of the method according to the present invention. In these drawings the same numerals are used to identify the same elements. In the drawings;

FIG. 4 is an enlarged cross-section view of the mercury capsule as seen in FIGS. 2 and 3;

FIG. 5 is a graph showing a typical damped vibration in a rigid object such as the striking surface of a golf club;

FIG. 6 shows a graph of a measured vibration in the striking surface of a golf club;

DETAILED DESCRIPTION OF THE PREFERRED EMBODIMENT

While the method according to the present invention can be carried out in different ways, there is described herein, while making reference to the drawings, one preferred method for calibrating a backlash impulse device, with the understanding that the present disclosure is to be considered as an example of the principles of the invention and is not intended to limit the invention to this preferred method.

Figure 1:
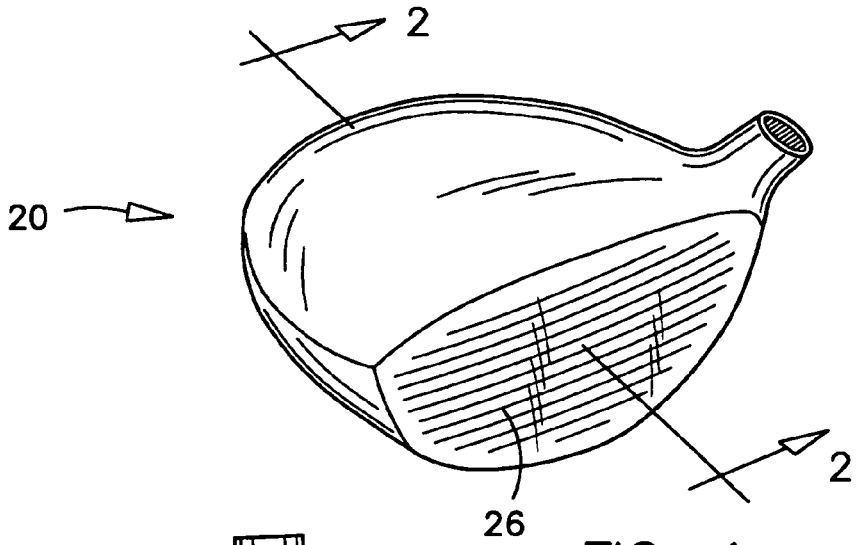
FIG. 1 is a perspective view of a golf club head of the driver type, and a reference line for locating a cross-section view thereof.
Figure 2:
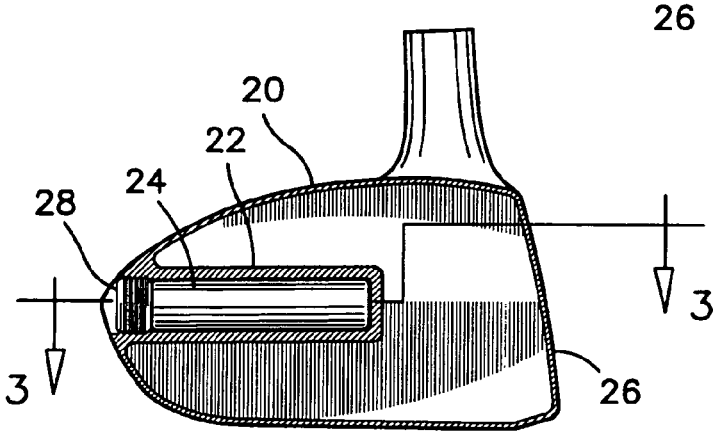
FIG. 2 is a longitudinal cross-section view of the golf club head taken along line 2-2 in FIG. 1.
Figure 3:
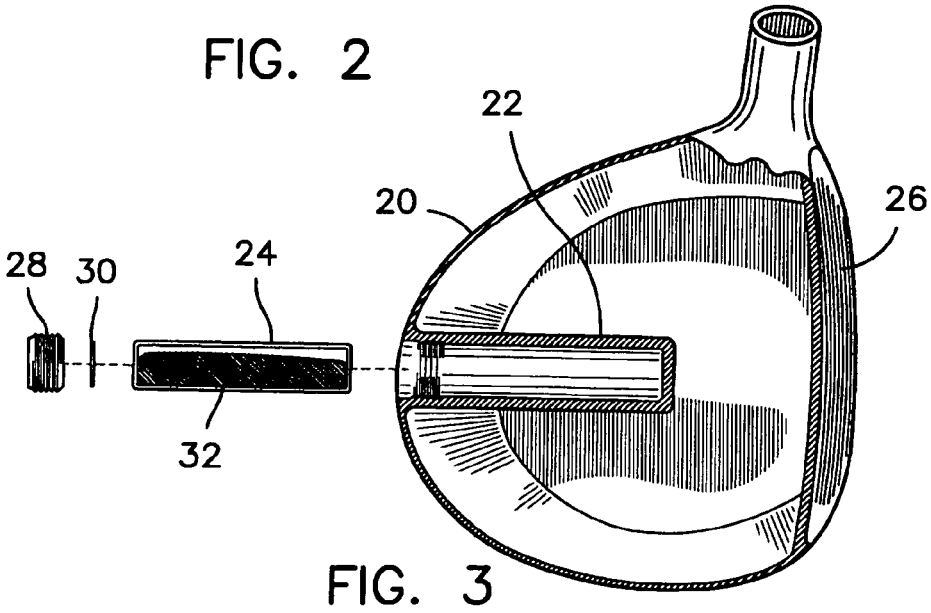
FIG. 3 is a plan cross-section view of the golf club head taken along line 3-3 in FIG. 2.

Referring firstly to FIGS. 1, 2 and 3; there is illustrated therein a golf club head 20 of the driver type, having a metallic shell. The golf club has a cylindrical cavity 22 therein and a cylindrical capsule 24 mounted in the cylindrical cavity 22. The cavity 22 is affixed to the back side of the club head, and is oriented generally at a right angle with the striking surface 26 of the club head 20. The cavity 22 has an opening through the shell of the club head, and this opening is made to receive a threaded plug 28. The capsule 24 is held in the cavity 22 by the threaded plug 28. One or more spacers 30 may be mounted between the threaded plug 28 and the back end of the capsule 24 to firmly retain the capsule 24 inside the cavity 22.

The capsule 24 is partly filed with a mercury mass 32. The capsule is only partly filled, as may be seen in FIG. 4, in order to provide free space 'D' for a displacement of the mercury mass 32 inside the capsule 24. The interior of the capsule 24 may be coated or plated with a smooth material having no adherence to mercury, and a vacuum may be formed therein such that a movement of the mercury mass 32 inside the capsule 24 is substantially frictionless.

Referring now to FIG. 5, there is shown therein a typical damped force vibration in a stiff object, in which the distance 'P' represents the period of the natural frequency of the object, and in the present context, 'P' represents the period of the natural frequency of the striking surface 26 of the club head 20.

In this drawing, point 40 represents the impact of a golf ball against the striking surface 26 of the club head 20; the segment 42 represents the inward deflection of the striking surface 26, from the force of the impact. The segment 44 represents the period of elastic recovery, or restitution, of the striking surface 26. It will be appreciated that in most cases, a struck golf ball leaves the striking surface 26 at the end of segment 44, at point 46 or slightly before if the restitution of the golf ball is much faster than the restitution of the striking surface 26.

The occurrence of a ball leaving the striking surface 26 of the club head before point 46 should be in rare cases only, because the popular trend in the art is to manufacture the striking surfaces of golf clubs with much stiffer materials than in the past.

There are also suggestions in this industry for manufacturing golf clubs in which the striking surface has a period of restitution that is at least approximately in phase with the period of restitution of a struck ball. These methods are explained in the following documents;

U.S. Pat. No. 4,928,965 issued to T. Yamagushi et al., on May 29, 1990, and

U.S. Pat. No. 5,816,963 issued to R. Brooks et al., on Oct. 6, 1998.

For these reasons, it should be appreciated that in most uses of modern golf clubs, a golf ball stays in contact with the striking surface 26 for a period starting at point 40 and ending at point 46 or very close to point 46, as shown in FIG. 5. In FIG. 5, the segment 44 represents the period of elastic recovery of the striking surface 26 wherein the striking surface 26 pushes the struck ball forward.

It will be understood that a backlash impulse on the striking surface 26 of a club head 20 should occur during the period 'R' of elastic recovery, to have a beneficial effect on the struck ball. If this secondary impulse occurs during the time segment 42, before the region 'R', this secondary impulse would reduce the elastic deformation of the striking surface 26, and limit the amount of energy that can be transferred to the ball by the striking surface. On the other hand, if this backlash impulse occurs after the point 46, it would have no effect at all on the struck ball, because at that time, the ball has already left the striking surface 26 of the club.

Because of the phenomenon of natural frequency in stiff objects, the period of elastic recovery 'R' is exactly one half of the period 'P' of one vibration cycle in the club face 26. The beginning of the period of elastic recovery, at point 48, occurs at a time 'T' which is exactly one half of the period 'R' or exactly one quarter of the period 'P'.

The purpose of the present method is to calibrate the displacement 'D' of the mercury mass 32 inside the capsule 24 such that an impulse produced by the mercury mass 32 striking the forward end 50 of the capsule 24 occurs during the period of elastic recovery 'R' of the striking surface 26 of the club 20, during the first vibration cycle following an impact with a struck ball. More specifically, the purpose of the preferred method is to calibrate the displacement 'D' of the mercury mass 32 such that a backlash impulse is synchronized with the beginning of the elastic recovery period 'R' during the first vibration cycle following an impact from the struck ball. Ideally, the backlash impulse should occur at time 'T' or shortly after, at mid-span along the period 'R' for example, but no later than the end of the period 'R'.

The relation between the period of elastic recovery 'R' and the time of travel of the mercury mass 32 inside the capsule 24 over the distance 'D' depends on three variables; swing speed of the club; natural frequency of the striking surface 26, and relative speed of the mercury mass 32 inside the capsule 24.

The relative speed of the mercury mass 32 depends on the deceleration of the golf club upon impact with a golf ball, and on the corresponding acceleration of the mercury mass 32 inside the capsule 24 along the distance of travel 'D' following the impact. The amounts of deceleration and acceleration mentioned above depend on the swing speed, on the inertia of the golf club and of the golf ball, on a coefficient of friction between mercury mass 32 and the inside wall of the capsule 24, and on the presence of air inside the capsule 24.

Because of all these variables, the relative speed of the mercury mass 32 inside the capsule 24 is best determined by measuring the time it takes for the mercury mass 32 to cover the distance of travel 'D' inside the capsule 24, as will be explained hereinafter.

A) Swing Speed

The speed of a club head before and after an impact with a ball is obtained using a radar speed measuring device such as those described in the following documents, for examples;

U.S. Pat. No. 3,945,646 issued to J. L. Hammond on Mar. 23, 1976; or

U.S. Pat. No. 6,898,971 issued to A. E. Dilz, Jr. et al. on May 31, 2005.

B) Natural Frequency

The occurrence and duration of the elastic recovery period 'R' and of the preferred backlash delay 'T' in a striking surface of a golf club following an impact is obtained by measuring the natural frequency of the striking surface 26 of a club head using vibration analysis instruments and methods such as those described in;

U.S. Pat. No. 5,703,294 issued to K. G. McConnell et al., on Dec. 30, 1997;

U.S. Pat. No. 6,997,035 issued to H. Saegusa et al., on Feb. 14, 2006; or

U.S. Pat. No. 6,709,344 issued to M. J. Erickson et al., on Mar. 23, 2004.

C) Relative Speed and Time of Travel

The relative speed of the mercury mass 32 inside a capsule 24 is obtained by measuring the time of travel between the impact of the club with a golf ball at a specific swing speed and the impulse from a backlash impulse device having a capsule of known distance 'D' installed in the golf club. This measurement is obtained using the same vibration analysis instruments as those mentioned above.

In a commercial environment, a number of capsules 24 with different distances 'D' and a same volume of mercury in each one are preferably tested in advance at different swing speeds. A chart of test results is preferably constructed to associate swing speeds and times of travel for each capsule 24.

It becomes a simple operation to measure the natural frequency in the striking surface of a purchased golf club, to ask a buyer his or her average swing speed, and to install a matching capsule in the purchased golf club. The installation of a capsule 24 in a golf club is effected using a sufficient number of spacers 30 to insure a tight fit of the capsule 24 inside the cavity 22.

In an alternate method, a determination of a proper capsule 24 in a golf club can also be made by extrapolation from two direct measurements of the vibration in a golf club hitting a ball at a same swing speed in two experiments using a different capsule in each test. Of course, a final verification by direct vibration measurement is also recommended to confirm the installation of a proper capsule in a golf club to be used at the specific swing speed.

In summary, the determination of a proper capsule 24 for a golf club is preferably effected according to the following steps;

Determine from the natural frequency of the striking surface of a club head, the time period 'T' between an impact and the beginning of the elastic recovery of the striking surface, and the duration 'R' of the period of elastic recovery;

Determine by choice of a golfer, a swing speed at which the golf club should be calibrated;

Using the swing speed and the period 'T' preceding the period of elastic recovery of the striking surface, determine from a chart associating swing speeds and times of travel of different capsules, or by extrapolation from direct vibration measurements, a capsule having a proper free space 'D' therein to generate a backlash impulse at the same time as the occurrence of the period of elastic recovery 'R' of the club face in the initial vibration cycle in the striking surface following a strike; and Install the selected capsule in the club head.

The feasibility of this method has been tested with a club head of the type described herein before, made of a titanium. The results are explained using the graphs in FIGS. 6-8.

The natural frequency of the club head was determined using accelerometers and a well known hammer test. The period 'P1' of the natural frequency in the striking surface 26 has been found to be 0.3 millisecond. From this measurement, one can determine that the duration of the elastic recovery phase 'R' is 0.15 millisecond, and the beginning 'T' of the recovery phase 'R' is at 0.075 millisecond from the time of impact against a golf ball.

The graphs of FIGS. 5 and 6 differ from each other over a same period of a natural vibration because the graph of FIG. 5 is a representation of a deflection in the striking surface 26 of a club and the graph of FIG. 6 shows acceleration amplitudes.

Figure 7:
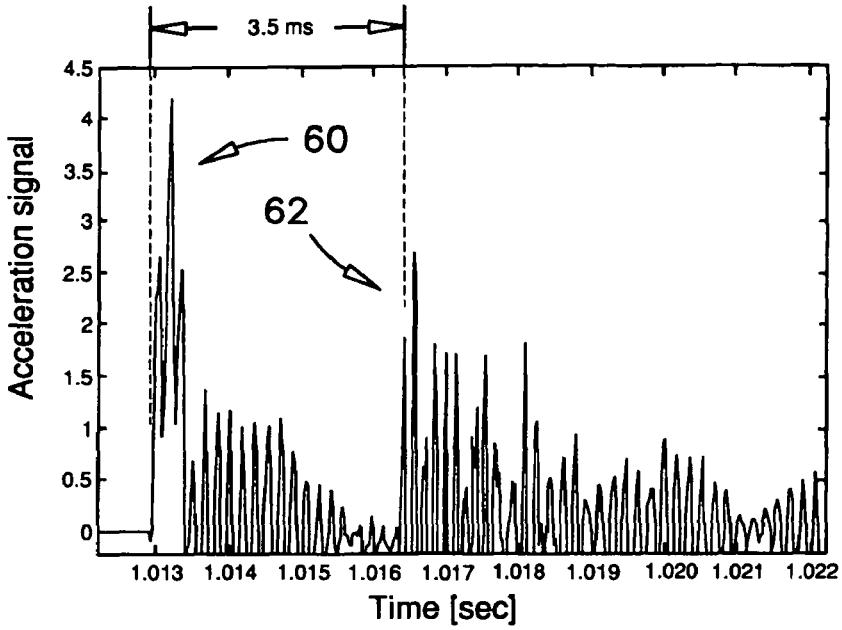
FIG. 7 is a graph showing the vibration in the striking surface of the golf club mentioned above having a backlash impulse device mounted therein, from an impact with a golf ball, wherein the mercury mass in the device had a distance of travel of 0.343 inch.
Figure 8:
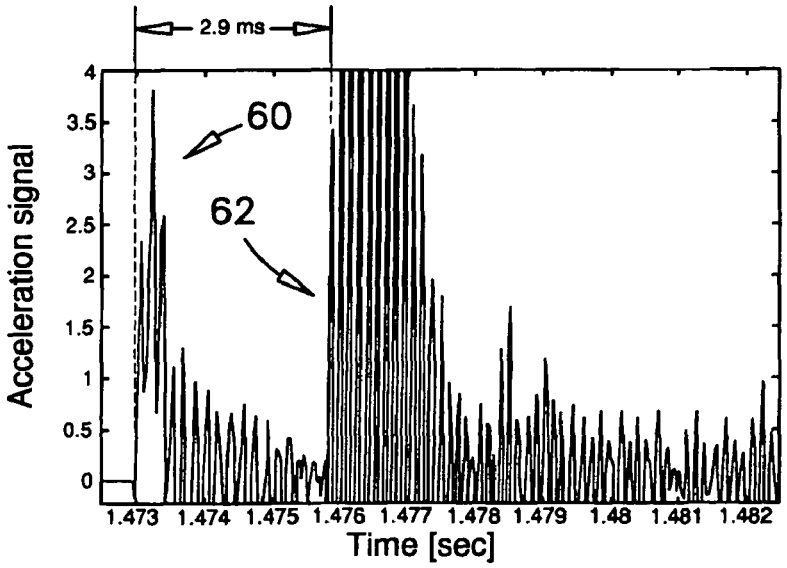
FIG. 8 is a graph showing the vibration in the striking surface of the golf club mentioned above having a backlash impulse device mounted therein, from an impact with a golf ball, wherein the mercury mass in the device had a distance of travel of 0.229 inch.

The graph of FIG. 7 shows the vibration in the striking surface 26 of the club head 20 having a backlash impulse device mounted therein, after an impact 60 against a golf ball, at a speed of 8 miles per hour. The backlash impulse device had a capsule 22 containing 14 grams of mercury, and a free space 'D' inside the capsule, of 0.343 inch. The backlash impulse 62 occurred at 3.5 milliseconds after the ball impact 60, as shown in FIG. 7.

In a second test, at a same swing speed of 8 miles per hour, the capsule 22 had 16 grams of mercury therein, leaving a free space 'D' of 0.229 inch. The backlash impulse 62 occurred at 2.9 milliseconds after the impact 60.

In the first case, the mercury mass 32 had a calculated average relative speed of 70% of the club speed before impact. In the second case, the mercury mass 32 had a calculated average relative speed of 56% of the club speed before impact. These differences in relative speed may be explained by the different distances of travel 'D' in both experiments, wherein the mercury mass 32 in the first experiment had more distance to accelerate and to reach a higher speed.

One can appreciate from these experiments that a reduction in the length 'D' of the free space inside a capsule has produced a perceivable and predictable difference in the timing of the backlash impulses. It will be appreciated that the two experiments described herein are sufficient to confirm the feasibility of the preferred calibration method.

Based on the experiments just described, the following theoretical calculations were made to further confirm that the method according to the present invention is feasible and practical. These calculations were made assuming different relative speeds of the mercury mass for different swing speeds of the golf club before impact.

TABLE 1

| Swing speed | Relative speed of the mercury mass | 'D' for impulse at time 'T' in FIG.5 | 'D' for impulse at mid-span along 'R' |
|---|---|---|---|
| 40 mph | 50%-20 mph | 0.026 inch | 0.053 inch |
| 60 mph | 40%-24 mph | 0.032 inch | 0.063 inch |
| 80 mph | 30%-24 mph | 0.032 inch | 0.063 inch |
| 100 mph | 25%-25 mph | 0.033 inch | 0.066 inch |
| 120 mph | 25%-30 mph | 0.040 inch | 0.079 inch |

Although the relative speeds of the mercury mass, as estimated in the above table, may not be the same as those to be measured in an actual application, it is believe that the order of magnitude of the distances 'D' in a real application will be substantially the same as the distances shown therein. More importantly, it will be appreciated that the differences in travel distances between an impulse at the beginning of the period of elastic recovery and an impulse at a mid-span during that period, show that a level of precision with which a distance 'D' must be calibrated is relatively easy to achieve by a machinist for example. These differences also show that each capsule size can be used in a fair range of swing speeds.

Figure 9:
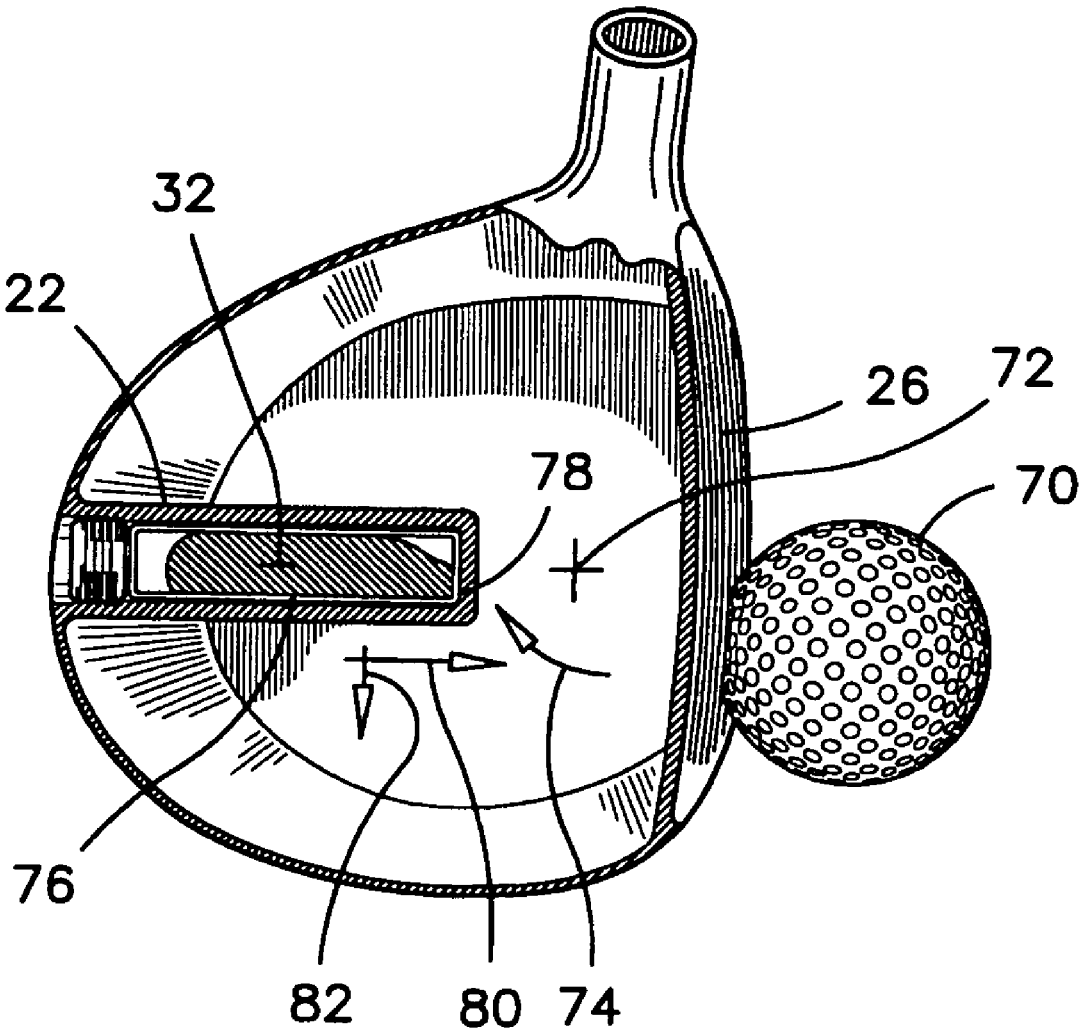
FIG. 9 shows a plan cross section view of a golf club substantially as seen in FIGS. 1-3, for the purpose of describing one of the advantages of a calibrated backlash impulse device in a golf club.

Referring now to FIG. 9, this drawing will be used to describe an advantage of a backlash impulse device that is properly calibrated to produce an impulse during the recovery period of the club face.

When a ball 70 is struck to one side of the center of gravity 72 of a club head, the impact generates a torque about the center of gravity of the club head, such as illustrated by arrow 74. This torque 74 causes the club head to tilt slightly in the direction of the arrow 74. Because the mercury mass 32 has inertia, it tends to collapse against the capsule's wall 76 on the same side as the source of the torque 74. The mercury mass 32 also tends to collapse against the front corner 78 of the capsule on the same side of the ball 70. Therefore, the impulse produced by the mercury mass 32 has a longitudinal component 80 and a lateral component 82. This lateral component 82 produces a torque in the opposite direction from the torque 72, to redress the face 26 of the club.

Also, the inertia of the mercury mass 32 itself mounted at a distance from the center of gravity 72 generates a moment to resist a tilting from such slice or hook shots.

As a result, shots struck with a club having a mercury capsule-type impulse device mounted therein are generally straighter and more powerful than strikes made with other clubs not having this device.

While one embodiment of a calibration method has been explained herein, it will be appreciated by those skilled in the art that various alternate steps and equivalents may be employed to obtain the same result. It will also be appreciated that the same method can be used to calibrate a backlash impulse with the period of restitution of a golf ball if that period is much shorter than the period of restitution of the golf club used for striking the ball. The method can also be used to calibrate a backlash impulse device in a sport implement other than a golf club. Therefore, the above description and the illustrations should not be construed as limiting the scope of the invention, which is defined by the appended claims.

What is claimed is:

1. A method for calibrating the timing of a backlash impulse device in a sport implement having a striking surface and a movable mass mounted therein, comprising the steps of;

measuring the natural frequency of said striking surface of said implement;

determining from said natural frequency a time of occurrence and a duration of a period of elastic recovery of said striking surface in a first vibration cycle following an impact on said striking surface and relating a movement of said movable mass to said first vibration cycle;

adjusting a distance of travel of said movable mass during a strike of a ball with said sport implement such that an impulse generated by said movable mass during said strike occurs during said period of elastic recovery of said striking surface in said first vibration cycle;

wherein said movable mass comprises mercury enclosed in a cylindrical capsule and said step of adjusting a distance of travel is effected by selecting a single cylindrical capsule from a plurality of cylindrical capsules each having a same volume of mercury therein and a unique movable-mass travel distance, and mounting said single cylindrical capsule inside said implement; and wherein said step of selecting is effected by extrapolation from two different vibration measurements of impulses on said striking surface, caused by two different ones of said cylindrical capsules alternately mounted in said implement, in two different experiments carried out at a same swing speed of said sport implement.

2. The method as claimed in claim 1, wherein said step of adjusting includes the step of adjusting a distance of travel of said movable mass during a strike of a ball with said sport implement such that an impulse generated by said movable mass during said strike occurs between the beginning and a mid-span of said period of elastic recovery.

3. The method as claimed in claim 1, further including a measurement of vibration in said implement confirming a properly calibrated cylindrical capsule.

4. A method for calibrating the timing of a backlash impulse device in a golf club having a movable mass mounted therein, comprising the steps of;

striking a striking surface of said golf club at a swing speed;

measuring the natural frequency of said striking surface;

determining from said natural frequency a time of occurrence and a duration of a period of elastic recovery of said striking surface during a first vibration cycle in said striking surface during said step of striking;

relating a movement of said movable mass during said step of striking to said first vibration cycle;

adjusting a time of travel of said movable mass following an impact on said golf club at said swing speed such that a kinetic energy of said movable mass is transferred to said striking surface during said period of elastic recovery of said striking surface during said first vibration cycle;

wherein said movable mass comprises mercury enclosed in a cylindrical capsule and said step of adjusting said time of travel is effected by selecting a single cylindrical capsule from a plurality of cylindrical capsules each having a same volume of mercury therein and a unique movable-mass travel distance.

5. The method as claimed in claim 4, wherein said step of adjusting is effected such that said kinetic energy of said movable mass is transferred to said striking surface between a beginning of said period of elastic recovery, and a mid-span along said period of elastic recovery.

6. A method for calibrating the timing of a backlash impulse device in a sport implement having a striking surface, comprising the steps of;

measuring the natural frequency of said striking surface of said sport implement;

determining from said natural frequency a time of occurrence and a duration of a period of elastic recovery of said striking surface in a first vibration cycle following an impact on said striking surface;

alternately mounting a first and second capsules in said sport implement, wherein each of said capsules contains a same movable mass and a unique movable-mass travel distance;

striking said striking surface at a same swing speed in first and second experiments with said first and second capsules respectively;

obtaining vibrations measurements of impulses on said striking surface from said movable mass in said two experiments;

selecting by extrapolation from said vibration measurements; an unique capsule from a plurality of capsules each having said same movable mass therein and a different movable-mass travel distance, such that an impulse generated by said movable mass during a strike against said striking surface occurs during said period of elastic recovery of said striking surface in said first vibration cycle during said strike, and mounting said unique capsule inside said implement.

7. The method as claimed in claim 6, further including a measurement of vibration in said implement confirming a properly calibrated capsule.

* * * * *